United States Patent [19]

Sridharan

[11] Patent Number: 5,023,521

[45] Date of Patent: Jun. 11, 1991

[54] LAMP BALLAST SYSTEM

[75] Inventor: Sri P. Sridharan, Hickory Hills, Ill.

[73] Assignee: Radionic Industries, Inc., Chicago, Ill.

[21] Appl. No.: 451,612

[22] Filed: Dec. 18, 1989

[51] Int. Cl.[5] ..... H05B 41/16

[52] U.S. Cl. ..... 315/290; 315/247

[58] Field of Search ..... 315/247, 290

[56] References Cited

U.S. PATENT DOCUMENTS

| | | | |
|---|---|---|---|
| 3,465,204 | 9/1969 | Michalski | 315/363 |
| 3,569,776 | 3/1971 | Moerkena et al. | 315/102 |
| 3,588,599 | 6/1971 | Michalski | 315/209 |
| 3,659,150 | 4/1972 | Laupman | 315/106 |
| 3,700,962 | 10/1972 | Munson | 315/241 |
| 3,705,329 | 12/1972 | Vogeli | 315/103 |
| 3,836,817 | 9/1974 | Tchang et al. | 315/100 |
| 3,886,405 | 5/1975 | Kubo | 315/246 |
| 3,889,152 | 6/1975 | Bodine, Jr. et al. | 315/205 |
| 3,925,705 | 12/1975 | Elms et al. | 315/246 |
| 3,976,910 | 8/1976 | Owens et al. | 315/92 |
| 4,015,167 | 3/1977 | Samuels | 315/99 |
| 4,032,817 | 6/1977 | Richmond | 315/149 |
| 4,181,872 | 1/1980 | Chermin | 315/106 |
| 4,399,390 | 8/1983 | Oshita et al. | 315/101 |
| 4,442,380 | 4/1984 | Adachi | 315/290 X |
| 4,460,848 | 7/1984 | Fahnrich | 315/101 |
| 4,473,778 | 9/1984 | Adachi | 315/290 X |
| 4,847,535 | 7/1989 | Wisbey et al. | 315/101 |
| 4,914,354 | 4/1990 | Hammer et al. | 315/247 |

*Primary Examiner*—David Mis

*Attorney, Agent, or Firm*—Hill, Van Santen, Steadman & Simpson

[57] ABSTRACT

A ballast circuit for a fluorescent lamp includes a magnetic choke coupled between the lamp and a power supply and an electronic starter circuit coupled across said lamp. The magnetic choke includes an inductor and a capacitor to limit the supply of current to the lamp. The capacitor provides power factor correction and limits current supply without dissipating power in the form of heat. The electronic starter circuit includes a triac coupled across the lamp that is triggered by a diac coupled to the power supply input through a capacitor. When a sufficient charge builds up on the capacitor, the diac is triggered and, in turn, the triac is triggered to provide current through the electrodes of the lamp to thereby preheat the electrodes. Almost as instantly as the triac is triggered, the diac is caused to stop triggering the triac and therefore, the triac becomes non-conducting and is removed from the cirucit. Upon removal of the triac, the sudden stop of current flow causes the magnetic choke inductor to produce a voltage spike across the lamp electrodes to thereby cause an arc to extend between the electrodes. Selective dimming of the lamp is achieved by proper selection of the capacitor coupled to the magnetic choke.

15 Claims, 1 Drawing Sheet

LAMP BALLAST SYSTEM

BACKGROUND OF THE INVENTION

The present invention relates generally to ballast circuits for fluorescent lights and, particularly, to a hybrid ballast circuit for a fluorescent lamp including a magnetic choke and an electronic starter circuit.

In the lighting of fluorescent lamps, a gas enclosed within a glass tube is caused to become ionized, thus reducing a breakdown voltage between electrodes placed at opposite ends of the glass tube. Ionization is initiated by heating of the electrodes. Once the gas is sufficiently ionized, a voltage at or above the breakdown voltage is placed across the lamp electrodes to thereby cause a current arc to form across the electrodes. The arc produces a bright glow within the lamp tube and produces radiation that activates a fluorescent coating on the inner surface of the glass tube, to thereby produce a bright light.

In controlling the turning on and off of fluorescent lamps, it is necessary to control the current to the lamp and to provide a starting voltage. In fluorescent lamps, this task is performed by a circuit called a ballast. There are generally two types of ballasts: magnetic ballasts and electronic ballasts.

Presently, most low wattage fluorescent lamps utilize magnetic ballasts that include magnetic chokes or suitable magnetic transformers and glow bulb starters. The magnetic choke limits current flow to the lamp while the glow bulb starter creates a voltage spike across the lamp after sufficiently preheating the electrodes. These magnetic ballasts are considered inefficient because of considerable power dissipation in the magnetic components. Moreover, these ballasts exhibit low power factors because of highly inductive reactances of the magnetic chokes.

Further, the glow bulbs associated with these ballasts exhibit random starting times that produce unpleasant flashes as an arc attempts to be established across the electrodes of the lamp. This is especially true at low line voltages because the ballasts permit too much voltage to be applied to the bulbs, due to the inadequacies in the ballast design. Arcs are then produced across the bimetal components of the bulbs as the voltage will be nearly high enough to sustain arcing, and annoying flickering and restriking occurs. As a result, the performances of glow bulbs are not predictable and this results in unreliable starting times of the fluorescent lamps.

Electronic ballasts are very expensive and suffer from poor reliability due to the larger number of components involved. In these ballasts, a variety of electronic components are utilized to heat up the electrodes of the lamp and to establish the breakdown voltage across the electrodes. A most undesirable effect associated with these ballasts is the annoying electromagnetic waves generated by the circuits due to high frequency chopping of the alternating current power signal. These electromagnetic waves interfere with the operation of appliances such as T.V.'s and radios.

Magnetic ballasts have reliability problems after 6,000 cycles because of contact wear-out in the glow bulb starters associated therewith. Electronic ballasts suffer from similar reliability problems because of the larger number of discrete components used.

SUMMARY OF THE INVENTION

The present invention provides an improved ballast system for fluorescent lamps that can be operated almost indefinitely and that overcomes the disadvantages of glow bulb starters and electronic starters. To this end, there is provided a hybrid ballast circuit including a magnetic choke and an electronic starter circuit. The hybrid ballast circuit utilizes magnetic inductive components in series with a capacitor to approximately provide the required ballasting current for a fluorescent lamp. Further, an electric starter circuit placed across electrodes of the lamp momentarily heats the electrodes of the lamp and then provides a voltage spike sufficient to cause arcing across the electrodes before being effectively removed from the ballasting circuit.

DETAILED DESCRIPTION OF THE PREFERRED EMBODIMENT

Figure 1:
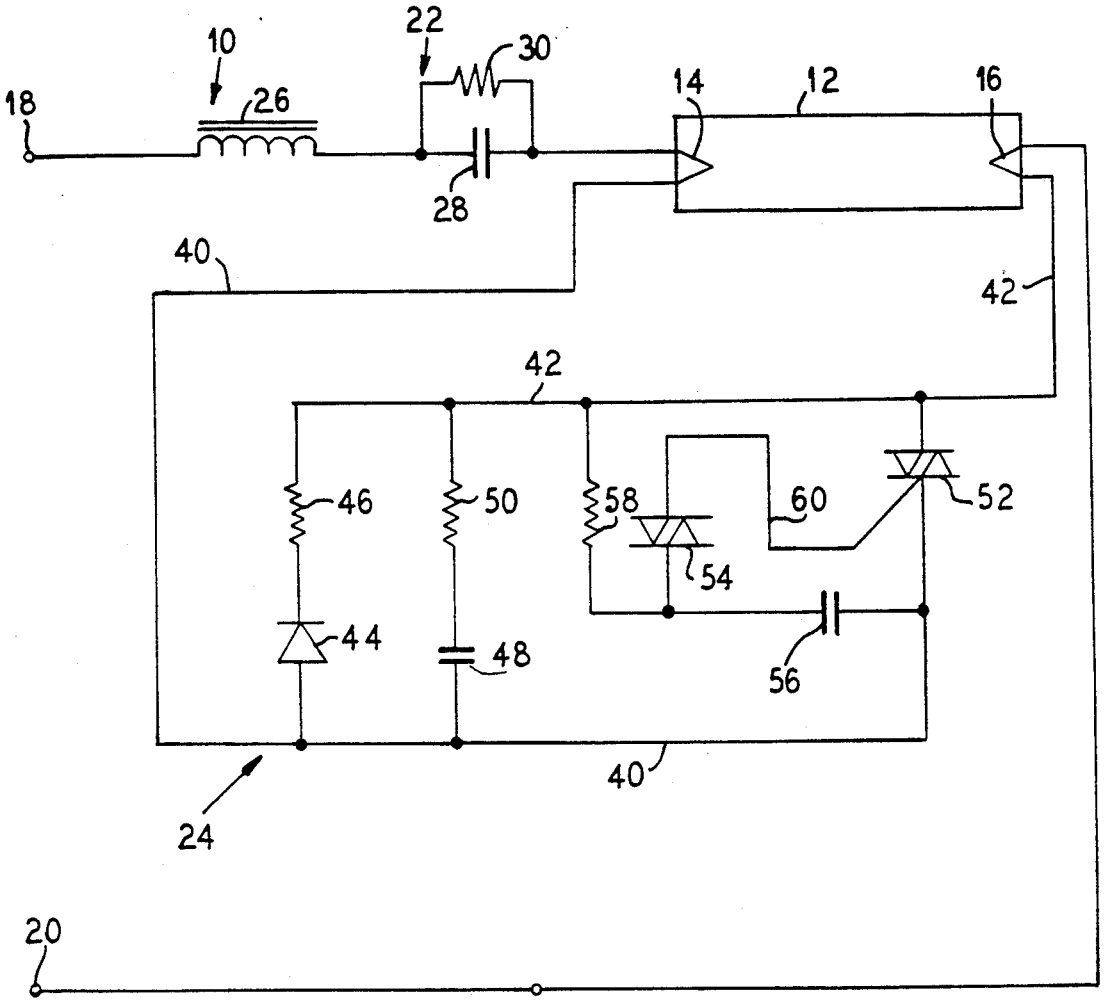
FIG. 1 is a circuit diagram of a hybrid ballast circuit for fluorescent lamps embodying principles of the invention.

In FIG. 1 there is illustrated a hybrid ballasting circuit 10 embodying principles of the invention. The circuit 10 is connected to and associated with a fluorescent lamp 12 having electrodes or filaments 14 and 16 to provide both current limitation to the lamp 12 and the required starting voltage.

As illustrated, the circuit 10 includes terminals 18 and 20 to which is operatively switched an incoming alternating current power source suitable for operating the lamp 12. The circuit 10 further includes a magnetic choke circuit 22 and an electronic starter circuit 24, the description of which follow.

The magnetic choke circuit 22 includes an inductor 26 in series with a capacitor 28 both of which are coupled between the electrode 14 of the lamp 12 and the terminal 18. As can be appreciated, inductor 26 prevents any rapid change in the flow of current to the lamp 12 from the power source while the capacitor 28 determines the level of current through the circuit 10. A resistor 30 coupled across the capacitor 28 acts as a bleeder resistor to discharge any charge stored in the capacitor 28 to reduce the voltage of the capacitor 28 to a safe value when the power supply is abruptly turned off or switched off. The value of the resistor 30 preferably is very high such as 470K ohms, so as to not provide a suitable alternative current path to the capacitor 28 when the circuit 10 is turned on. Thus, it can be appreciated that the inductive and capacitive reactances provided by the inductor 26 and capacitor 28, respectively, provide the necessary ballasting impedance to limit the current to the desired level for the fluorescent lamp 12.

The inductor 26 is specifically designed so that the capacitor 28 can be changed to accommodate various lamp wattages. Thus, it is possible to employ different lamps in connection with the circuit 10 simply by selecting an appropriate capacitor 28.

In the design of the inductor 26, several parameters are important in the provision of appropriate electrical characteristics required thereof for the circuit 10. Accordingly, the core, the coil wire, the number of turns of the coil, and the gap between the core and coil of the inductor 26 are chosen to meet the specific requirements of the ballast circuit 10.

The inductor 26 preferably includes a core made of laminated electrical grade steel. The steel used preferably is rated M-43 grade with a 24 gauge lamination. The coil preferably has 1800 nominal turns of enamel copper wire having a thickness of 32½ AWG (American Wire Gauge). A gap between the core and coil is introduced by means of an electrical grade fish paper having a thickness of about 12.5 mils (0.0125 inch). This design results in an inductor 26 having an average inductance of 860 millihenrys. The average direct current resistance of the inductor 26 is 70 ohms at an ambient temperature of 22° C. It is noted that the manufacturer of this inductor is possible with a minimal copper and core loss and at a reasonable manufacturing cost level.

Electronic starter circuit 24 acts as a momentary switch just like a glow bulb starter to provide a suitable starting voltage as well as preheat current to the electrodes 14 and 16. As illustrated, a lead 40 coupled to the input of the circuit is also coupled to one electrode 14 of the lamp 12. A lead 42 coupled to the output of the circuit 24 is also coupled to the electrode 16 of the lamp 12. Thus, the electronic starter circuit 24 is coupled across the lamp 12.

Coupled between the leads 40 and 42 are three parallel circuits. The first circuit includes the series connection of a diode 44 and a resistor 46. As illustrated, the diode 44 permits current to flow from the lead 40 to the lead 42 during the positive portion of each cycle of the power source signal. The second circuit includes a capacitor 48 coupled in series with a resistor 50. The capacitor 48 and resistor 50 form a snubber circuit. The third circuit includes a triac 52 coupled between leads 40 and 42 and a diac 54 with associated capacitor 56 and associated resistor 58 operatively coupled between leads 40 and 42 to provide triggering of the triac 52. A lead 60 extends between the diac 54 and triac 52 to provide the triggering current for the triac 52.

Once the input voltage has been placed across the leads 18 and 20, the voltage across the leads 40 and 42 will increase as permitted by the inductor 26. As the voltage across the leads 40 and 42 increases, current flows through the diode 44 and resister 46 every positive half cycle, thereby preheating the filaments 14 and 16 to prepare for the discharge of electricity across the lamp 12. During the negative half of the cycle, the capacitor 56 gets charged through resistor 58. When the stored charge potential across capacitor 56 reaches the breakdown voltage of the diac 54, the diac 54 is triggered to conduct and, in turn, provides the trigger current to the triac 52 through the lead 60.

Once the triac 52 is triggered, it provides a momentary short between the leads 40 and 42, to thereby provide the necessary preheat current to the electrodes 14 and 16 as determined by the inductor 26 and the capacitor 28. The preheat current is utilized to heat the electrodes 14 and 16, and as is known, to ionize gas within the lamp 12.

However, the triac 52 is only on for a fraction of a second before it turns off. This occurs because once the triac 52 is triggered, all of the current through the starter circuit 24 passes through the triac 52. No current charges the capacitor 56 and thus, the diac 54 is no longer triggered. Once the diac 54 is no longer triggered, the triac 52 is no longer triggered.

When the triac 52 opens, the sudden interruption of current through the inductor 26 produces a voltage spike across the lamp 12 thereby striking an arc therein across the electrodes 14 and 16 to light the lamp 12. Once the lamp 12 is lighted, a very low impedance path is provided therethrough, and virtually all of the current through the circuit 10 is transmitted across electrodes 14 and 16 through the arc produced thereacross. Since virtually all of the current through the circuit 10 passes through the lamp 12, the electronic starter circuit 24 is, in effect, removed from the circuit 10. Additionally, because of the relatively short turn-on time of typically 0.4 second, any power factor phase shift is virtually eliminated and the circuit 10 can operate almost indefinitely, i.e., over many cycles greater than 6,000 to 8,000. Moreover, the ballast circuit 10 enjoys a power factor of about 80%, a vast improvement over the typical maximum of about 50% of magnetic ballasts.

In the preferred embodiment, the capacitor 28 has a value of about 1.8 microfarads The resistor 30 has a value of about 750K ohms. The diode 44 is of the type designated IN4004. The resistor 46 has a value of about 47K ohms. The capacitor 48 has a value of about 0.022 microfarads The resistor 50 has a value of about 470 ohms. The diac 54 is of the type designated HT-35. The resistor 58 has a value of about 560K ohms. The capacitor 56 has a value of about 0.033 microfarads. To ensure that the circuit 10 meets the requirements of the system, the components are chosen to have the above-mentioned characteristics within a 5% tolerance level.

The triac 52 is of the type designated Q401E4. The triac 52 is specifically selected to have an appreciable gate sensitivity in all quadrants. To that end, the triac 52 is selected so as to have a gate trigger current, of less than 8 milliamps within a 5% range of tolerance. This produces reliable starting of the fluorescent lamp 12.

The ballast circuit 10 is designed primarily to be used to operate F8T5 and/or F13T5 fluorescent lamps. F8T5 lamps are 8 watt lamps while F13T5 lamps are 13 watt lamps. As set forth above, the only variable components in the circuit 10 is the capacitor 28. Whenever a lamp 12 is changed, only the capacitor value need be changed because the inductance is held constant by the special design of the inductor 26, as described above. For an F8T5 lamp (8 watt lamp) a capacitor of 1.8 microfarads is used. For an F13T5 lamp (13 watt lamp) the value of the capacitor 28 is chosen to be 2 microfarads.

The circuit 10 also eliminates the need for a special lamp holder. In previous designs, a lamp normally would require a magnetic ballast including an auto transformer with an output voltage of 220 volts to start the lamp. In accordance with certain standards such as those set forth by Underwriters Laboratories, Inc., the presence of the 220 volt source requires the provision of a thereby requiring a special disconnect lamp holder to avoid electrical shock when changing the lamp. However, with the present circuit design, the voltage level to the lamp leads is brought down to the nominal line voltage to 120 volts, thereby eliminating the need for a special disconnect lamp holder.

Figure 2:
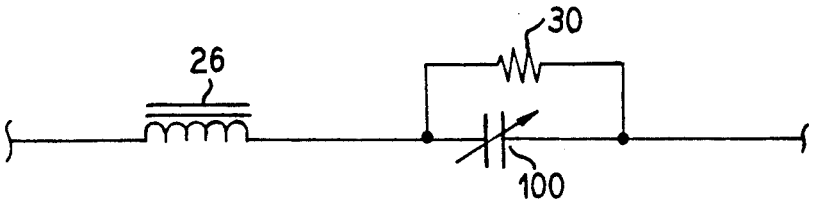
FIG. 2 is a partial circuit diagram of a portion of a hybrid ballast circuit of FIG. 1 including a dimmer circuit.

In another embodiment of the invention, illustrated in FIG. 2, the circuit 10 has been altered slightly to provide dimming of the fluorescent lamp 12. As illustrated, the capacitor 28 has been replaced by a variable capacitor 100. In the alternative embodiment, the current level in the circuit 10 is determined by the present value of the capacitor 100. Resistor 30 still serves as a bleeder to discharge any charge stored in the capacitors 100 when the power supply is cut off or switched off, as described previously. While in the preferred alternate embodiment, the variable capacitor 100 includes discrete increments, a capacitor or combination of a switch and a plurality of capacitors can be substituted therefor and utilized just as easily. What is important is that the variable capacitor 100, or the equivalent thereof, simply selectively cuts down the current, but not the voltage supplied to the lamp 12. Moreover, it can be appreciated that the capacitor 100 provides power factor correction without needless heat dissipation.

In contrast to the prior art, the ballast circuit 10 is less sensitive to line voltage variations and does not allow restriking, i.e., relighting, of the lamp 12 in the presence of low line voltages (i.e., less than 110 volts). The circuit 10 is designed to perform optimally at lower line voltages such as 105 volts and to absorb voltage increases. Thus, because commercial line volts vary between about 105–120 volts, the ballast circuit 10 can accommodate and perform well throughout a range of voltages and no variations in light output can be detected.

Restriking, i.e., the phenomenon ever present in glow bulb starters at low voltages which involves the turn off and attempt to restart of a lamp (flickering) is eliminated by virtue of the circuit design. The choke circuit 22 components, including the components of the inductor 26, are chosen so as to not permit voltages to leak through at low line voltages. As a result, the electronic starter circuit 24 does not receive enough voltage so as to react to attempt to start the lamp 12. Thus, restriking or flickering is eliminated.

While a preferred embodiment has been shown, modifications and changes may become apparent to those skilled in the art which shall fall within the spirit and scope of the invention. It is intended that such modifications and changes be covered by the attached claims.

I claim:

1. A ballast circuit for a fluorescent lamp, comprising:

means coupled between the lamp and an alternating current power supply for limiting changes in current flow to the lamp;

means coupled between the lamp and the power supply for correcting the power factor between the lamp and the power supply and for controlling current flow in the circuit;

electronic starter means coupled across electrodes of the lamp for providing current through said electrodes for preheating said electrodes, said starter means comprising a triac coupled across said electrodes, said triac having a trigger input coupled to a diac that in turn is coupled to a capacitor coupled to said power supply so that said triac is triggered whenever a sufficient voltage builds up across said capacitor to trigger said diac, said triac and means for limiting current changes being disposed such that termination of triggering of said triac causes a sufficient voltage pulse to be produced across said electrodes to produce an arc thereacross;

a snubber circuit coupled across said triac and comprising a resistor and capacitor connected in series so that said starter means is prevented from latching at the triggering point of said triac; and a diode and resistor coupled in series to form a preheating current path which in turn is coupled across said electrodes thereby to provide additional preheat current through said electrodes during every other half cycle of said current prior to production of said arc.

2. A ballast circuit as set forth in claim 1, wherein said means for limiting current to said lamp includes an inductive reactor.

3. A ballast circuit as set forth in claim 1, wherein said means to correct the power factor and to control the flow of current includes a capacitor.

4. A ballast circuit as set forth in claim 1, wherein said means to limit the current to said lamp includes an inductive reactor and said starter means includes a triac coupled across said electrodes and means for operatively triggering said triac, so that triggering of said triac places a short circuit across said electrodes, and subsequent termination of said triggering of said triac causes said inductive reactor to initiate a voltage spike across said lamp to cause arching across said electrodes.

5. A ballast circuit as set forth in claim 4 wherein said inductor reactor comprises:

(a) a core, said core being made of electrical grade steel rated M-43 grade with a 24 gauge lamination;

(b) a coil having about 1800 turns of enamel copper wire having a thickness of 32½ AWG; and (c) a gap between said core and said coil filled with electrical grade fish paper having a thickness of 12.5 mils;

whereby said inductor has an average conductance of 1860 mh and an average direct current resistance of about 70 ohms at an ambient temperature of 22° C.

6. A ballast circuit as set forth in claim 1, further comprising dimmer means coupled between said lamp and said power supply for limiting current supply to said lamp to selectively dim said lamp.

7. A ballast circuit as set forth in claim 6, wherein said dimmer means comprises means for providing a plurality of capacitances.

8. A ballast circuit for a fluorescent lamp having two electrodes comprising:

a magnetic choke coupled between one of said electrodes and a power supply, said magnetic choke including an inductor and a first capacitor connected in series; and a starter circuit coupled across said electrodes, said starter circuit including a first path coupled across said electrodes having a diode and first resistor connected in series, a second path coupled across said electrodes including a second capacitor and a second resistor connected in series, a third path coupled across said electrodes including a third resistor and a third capacitor connected in series and a diac having an input connected between said third resistor and said third capacitor, and a triac coupled across said electrodes and having a triggering input connected to an output of said diac.

9. A ballast circuit as set forth in claim 8, wherein said first capacitor comprises a variable capacitor.

10. A ballast circuit as set forth in claim 8, wherein said inductor reactor comprises:

(a) a core, said core being made of electrical grade steel rated M-43 grade with a 24 gauge lamination;

(b) a coil having about 1800 turns of enamel copper wire having a thickness of 32½ AWG; and (c) a gap between said core and said coil filled with electrical grade fish paper having a thickness of 12.5 mils;

whereby said inductor has an average inductance of 1860 mh and an average direct current resistance of about 70 ohms at an ambient temperature of 22° C.

11. A ballast circuit for a fluorescent lamp, comprising:

a magnetic choke coupled between a lamp and an alternating current power supply and including an inductor ad a capacitor connected in series;

an electronic starter circuit coupled across electrodes of said lamp and including: a triad coupled across said electrodes and means for triggering said triac whenever power is applied to said ballast circuit so that said triac directs preheating current through said electrodes, means for turning off said triac shortly after triggering of a said triac and to place a voltage pulse across said electrodes to create an electrical are across said electrodes;

a snubber circuit coupled across said triac and including a capacitor and resistor connected in series, so that said snubber circuit prevents latching of said starter circuit about a triggering point of said triac; and a diode and resistor coupled in series to form a preheating current path which in turn is coupled across said electrodes thereby to provide additional preheat current through said electrodes during every other half cycle of said current prior to production of said arc.

12. A ballast circuit as set forth in claim 11, wherein said means for triggering said triac includes a diac having an output connected to a trigger input of said triac and having an input connected to a capacitor coupled to said power supply via said magnetic choke.

13. A ballast circuit as set forth in claim 12, wherein said magnetic choke capacitor is a variable capacitor.

14. A ballast circuit as set forth in claim 11, wherein said inductor reactor comprises:

(a) a core, said core being made of electrical grade steel rated M-43 grade with a 24 gauge lamination;

(b) a coil having about 1800 turns of enamel copper wire having a thickness of 32½ AWG; and (c) a gap between said core and said coil filled with electrical grade fish paper having a thickness of 12.5 mils;

whereby said inductor has an average inductance of 1860 mh and an average direct current resistance of about 70 ohms at an ambient temperature of 22° C.

15. A ballast circuit for a fluorescent lamp, comprising:

means including an inductive reactor coupled between the lamp and a power supply for limiting changes in current flow to the lamp;

means including a first capacitor coupled between the lamp and the power supply for correcting the power factor between the lamp and the power supply and for controlling current flow in the circuit;

starter means including a triac coupled across electrodes of the lamp for providing current through said electrodes for preheating said electrodes, said triac having a trigger input coupled to a diac that in turn is coupled to a second capacitor that in turn is coupled to one of said electrodes so that said triac is triggered whenever a sufficient voltage builds up across said second capacitor to trigger said diac, said starter means further comprising a snubber circuit coupled across said triac and comprising a resistor and a capacitor connected in series so that said starter means is prevented from latching at the triggering point of said triac, said starter means also comprising a further preheat circuit coupled across said electrodes and comprising a resistor and diode connected in series to form a preheating current path to provide additional preheating current through said electrodes during every other half cycle of said current, triggering of said triac placing a short circuit across said electrodes and subsequent termination of said triggering of said triac causing said inductive reactor to initiate a voltage spike across said lamp to cause arcing across said electrodes.

* * * * *